US011209000B2

(12) United States Patent
Moore et al.

(10) Patent No.: US 11,209,000 B2
(45) Date of Patent: Dec. 28, 2021

(54) COMPRESSOR HAVING CAPACITY MODULATION

(71) Applicant: Emerson Climate Technologies, Inc., Sidney, OH (US)

(72) Inventors: Phillip M. Moore, Piqua, OH (US); James W. Mcbean, Bellefontaine, OH (US); Robert V. Eyink, Troy, OH (US); Joseph B. Burton, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 217 days.

(21) Appl. No.: 16/508,894

(22) Filed: Jul. 11, 2019

(65) Prior Publication Data

US 2021/0010472 A1 Jan. 14, 2021

(51) Int. Cl.

| | |
|---|---|
| ***F04C 18/02*** | (2006.01) |
| ***F04C 27/00*** | (2006.01) |
| ***F04C 28/26*** | (2006.01) |
| *F04C 23/00* | (2006.01) |

(52) U.S. Cl.

CPC ..... *F04C 18/0215* (2013.01); *F04C 27/005* (2013.01); *F04C 28/265* (2013.01); *F04C 23/008* (2013.01)

(58) Field of Classification Search

CPC .. F04C 18/0215; F04C 27/005; F04C 28/265; F04C 23/008

See application file for complete search history.

(56) References Cited

U.S. PATENT DOCUMENTS

| | | | |
|---|---|---|---|
| 3,978,382 | A | 8/1976 | Pfarrer et al. |
| 4,041,542 | A | 8/1977 | Pfarrer et al. |
| 4,105,374 | A | 8/1978 | Scharf |
| 4,205,537 | A | 6/1980 | Dubberley |

(Continued)

FOREIGN PATENT DOCUMENTS

| | | | |
|---|---|---|---|
| CN | 1219648 | A | 6/1999 |
| CN | 1289011 | A | 3/2001 |

(Continued)

OTHER PUBLICATIONS

International Search Report regarding Application No. PCT/US2020/041629 dated Oct. 30, 2020.

(Continued)

*Primary Examiner* — Connor J Tremarche

(74) *Attorney, Agent, or Firm* — Harness, Dickey & Pierce, P.L.C.

(57) ABSTRACT

A compressor may include a shell assembly, first and second scrolls, a piston, and a piston-retention member. The piston engages the first scroll and may be partially received within a recess defined by the shell assembly. The piston and the shell assembly may cooperate to define a pressure chamber. The pressure chamber may be in selective fluid communication with a source of working fluid to control movement of the piston relative to the shell assembly. The piston-retention member may engage the piston and a rotationally fixed structure. The piston-retention member allows rotation of the piston relative to the first scroll in a first rotational direction and restricts rotation of the piston relative to the first scroll in a second rotational direction.

21 Claims, 13 Drawing Sheets

(56) References Cited

U.S. PATENT DOCUMENTS 4,252,506 A 2/1981 Hannibal
4,277,955 A 7/1981 Parker
4,332,144 A 6/1982 Shaw
4,358,254 A 11/1982 Hannibal
4,396,360 A 8/1983 Elson
4,515,539 A 5/1985 Morishita
4,745,777 A 5/1988 Morishita et al.
4,747,756 A 5/1988 Sato et al.
4,818,198 A 4/1989 Tamura et al.
4,946,361 A 8/1990 DeBlois et al.
4,982,572 A 1/1991 Moore
5,002,470 A 3/1991 Gormley et al.
5,059,098 A 10/1991 Suzuki et al.
5,123,818 A 6/1992 Gormley et al.
5,211,031 A 5/1993 Murayama et al.
5,240,389 A 8/1993 Oikawa et al.
5,328,344 A 7/1994 Sato et al.
5,329,788 A 7/1994 Caillat et al.
5,342,186 A 8/1994 Swain
5,345,785 A 9/1994 Sekigami et al.
5,385,453 A 1/1995 Fogt et al.
5,447,420 A 9/1995 Caillat et al.
5,609,478 A 3/1997 Utter et al.
5,611,674 A 3/1997 Bass et al.
5,613,841 A * 3/1997 Bass ..... F01C 21/102 417/310
5,678,985 A 10/1997 Brooke et al.
5,741,120 A 4/1998 Bass et al.
5,800,141 A 9/1998 Ceylan et al.
5,931,649 A 8/1999 Caillat et al.
6,027,321 A 2/2000 Shim et al.
6,047,557 A 4/2000 Pham et al.
6,053,715 A 4/2000 Hirano et al.
6,086,335 A 7/2000 Bass et al.
6,106,253 A 8/2000 Sakai et al.
6,120,255 A 9/2000 Schumann et al.
6,123,517 A 9/2000 Brooke et al.
6,171,076 B1 1/2001 Gannaway
6,193,473 B1 2/2001 Mruk et al.
6,196,816 B1 3/2001 Lifson et al.
6,206,652 B1 3/2001 Caillat
6,213,731 B1 4/2001 Doepker et al.
6,220,839 B1 4/2001 Sheridan et al.
6,264,446 B1 7/2001 Rajendran et al.
6,267,572 B1 7/2001 Suefuji et al.
6,280,154 B1 8/2001 Clendenin et al.
6,290,472 B2 9/2001 Gannaway
6,293,776 B1 9/2001 Hahn et al.
6,322,339 B1 11/2001 Mitsunaga et al.
6,393,852 B2 5/2002 Pham et al.
6,408,635 B1 6/2002 Pham et al.
6,412,293 B1 7/2002 Pham et al.
6,438,974 B1 8/2002 Pham et al.
6,449,972 B2 9/2002 Pham et al.
6,467,280 B2 10/2002 Pham et al.
6,478,550 B2 11/2002 Matsuba et al.
6,499,305 B2 12/2002 Pham et al.
6,519,958 B1 2/2003 Moon et al.
6,619,062 B1 9/2003 Shibamoto et al.
6,619,936 B2 9/2003 Perevozchikov
6,662,578 B2 12/2003 Pham et al.
6,662,583 B2 12/2003 Pham et al.
6,672,846 B2 1/2004 Rajendran et al.
6,679,072 B2 1/2004 Pham et al.
6,821,092 B1 11/2004 Gehret et al.
6,884,042 B2 4/2005 Zill et al.
6,929,455 B2 8/2005 Dreiman et al.
6,988,876 B2 1/2006 Ke et al.
7,094,043 B2 8/2006 Skinner
7,201,567 B2 4/2007 Wiertz et al.
RE40,554 E 10/2008 Bass et al.
RE40,830 E 7/2009 Caillat
7,721,562 B2 5/2010 Lifson et al.
RE41,955 E 11/2010 Rajendran et al.
8,485,789 B2 * 7/2013 Gu ..... F04C 23/008 417/26
8,517,703 B2 8/2013 Doepker
8,628,316 B2 1/2014 Stover et al.
2001/0002239 A1 5/2001 Pham et al.
2001/0045097 A1 11/2001 Pham et al.
2001/0049942 A1 12/2001 Pham et al.
2002/0085939 A1 7/2002 Sun et al.
2002/0178737 A1 12/2002 Pham et al.
2003/0033823 A1 2/2003 Pham et al.
2003/0084672 A1 5/2003 Pham et al.
2003/0089119 A1 5/2003 Pham et al.
2003/0094004 A1 5/2003 Pham et al.
2004/0123612 A1 7/2004 Pham et al.
2004/0265140 A1 12/2004 Sun et al.
2005/0142017 A1 6/2005 Liang et al.
2005/0244277 A1 11/2005 Hurst et al.
2006/0280627 A1 12/2006 Jayanth
2006/0288715 A1 12/2006 Pham et al.
2007/0022771 A1 2/2007 Pham et al.
2007/0130973 A1 6/2007 Lifson et al.
2008/0175737 A1 7/2008 Grassbaugh et al.
2008/0196445 A1 8/2008 Lifson et al.
2008/0223057 A1 9/2008 Lifson et al.
2008/0250812 A1 10/2008 Lifson et al.
2008/0314057 A1 12/2008 Lifson et al.

FOREIGN PATENT DOCUMENTS

EP 0747597 A2 12/1996
EP 0980978 A1 2/2000
EP 1087142 A2 3/2001
GB 2246451 A 1/1992
JP S56165701 A 12/1981
JP S5738690 A 3/1982
JP S6053601 A 3/1985
JP H01294987 A 11/1989
JP H0211882 A 1/1990
JP H02140477 A 5/1990
JP H0431689 A 2/1992
JP H04121474 A 4/1992
JP H04121478 A 4/1992
JP H04203489 A 7/1992
JP H0599164 A 4/1993
JP H062670 A 1/1994
JP H0791385 A 4/1995
JP H08200247 A 8/1996
JP H1037866 A 2/1998
JP H11141483 A 5/1999
JP 2001099078 A 4/2001
KR 20010081651 A 8/2001
KR 20050088765 A 9/2005
WO WO-9917066 A1 4/1999
WO WO-2006132638 A1 12/2006
WO WO-2007050063 A1 5/2007

OTHER PUBLICATIONS

Written Opinion of the ISA regarding Application No. PCT/US2020/041629 dated Oct. 30, 2020.
Nord-Lock Group, "Nord-Lock X-series." 70203EN, Jan. 2017 (2 pages).
Stanley Engineered Fastening, "Spiralock® Self-Locking Threaded Solutions: Fasteners & Threading Tools." Stanley Black & Decker, Inc., 2017 (44 pages).

* cited by examiner

COMPRESSOR HAVING CAPACITY MODULATION

FIELD

The present disclosure relates to a compressor having capacity modulation.

BACKGROUND

This section provides background information related to the present disclosure and is not necessarily prior art.

A climate-control system (e.g., a heat-pump system, an air-conditioning system, a refrigeration system, etc.) may include a fluid circuit having an outdoor heat exchanger, an indoor heat exchanger, an expansion device disposed between the indoor and outdoor heat exchangers, and a compressor circulating a working fluid (e.g., carbon dioxide or any other refrigerant) between the indoor and outdoor heat exchangers. Efficient and reliable operation of the compressor is desirable to ensure that the climate-control system in which the compressor is installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that may include a shell assembly, a first scroll, a second scroll, a piston, and a piston-retention member. The shell assembly may define a discharge chamber. The first scroll is disposed within the shell assembly and includes a first end plate and a first spiral wrap extending from the first end plate. The second scroll is disposed within the shell assembly and includes a second end plate and a second spiral wrap extending from the second end plate. The first and second spiral wraps mesh with each other to form a plurality of fluid pockets therebetween. The piston engages the first scroll and may cooperate with the shell assembly to define a pressure chamber therebetween. The piston may be partially received within a recess defined by the shell assembly, and the pressure chamber may be disposed within the recess. The pressure chamber may be in selective fluid communication with a first source of working fluid to control movement of the piston relative to the shell assembly. The piston-retention member may engage the piston and a rotationally fixed structure. The piston-retention member allows rotation of the piston relative to the first scroll in a first rotational direction and restricts rotation of the piston relative to the first scroll in a second rotational direction that is opposite the first rotational direction.

In some configurations of the compressor of the above paragraph, the pressure chamber may be in selective fluid communication with a second source of working fluid. The first source of working fluid may be a source of working fluid at a first pressure (e.g., suction pressure). The second source of working fluid may be a source of working fluid at a second pressure (e.g., discharge pressure) that is higher than the first pressure.

In some configurations of the compressor of any one or more of the above paragraphs, the rotationally fixed structure is a partition of the shell assembly. The partition defines the discharge chamber and a suction chamber.

In some configurations of the compressor of any one or more of the above paragraphs, the piston-retention member is pivotably mounted to the partition and selectively engages one of a plurality of notches formed on the piston.

In some configurations of the compressor of any one or more of the above paragraphs, the piston-retention member is pivotably mounted to a wear ring of the partition.

In some configurations of the compressor of any one or more of the above paragraphs, the piston-retention member is pivotably mounted to the piston and selectively engages one of a plurality of notches formed on the partition.

In some configurations of the compressor of any one or more of the above paragraphs, the plurality of notches are formed on a wear ring of the partition.

In some configurations of the compressor of any one or more of the above paragraphs, the rotationally fixed structure is the shell assembly.

In some configurations of the compressor of any one or more of the above paragraphs, the rotationally fixed structure is an end cap of the shell assembly. The end cap may define the pressure chamber and the discharge chamber.

In some configurations of the compressor of any one or more of the above paragraphs, the piston-retention member is pivotably mounted to the piston and selectively engages one of a plurality of notches formed on the end cap.

In some configurations of the compressor of any one or more of the above paragraphs, the piston-retention member is disposed in the pressure chamber.

In some configurations of the compressor of any one or more of the above paragraphs, a spring engages the piston-retention member and the rotationally fixed structure. The spring biases the piston-retention member into engagement with a selected one of a plurality of notches.

In some configurations of the compressor of any one or more of the above paragraphs, the rotationally fixed structure includes the first scroll.

In some configurations of the compressor of any one or more of the above paragraphs, the piston-retention member includes a first locking ring and a second locking ring.

In some configurations of the compressor of any one or more of the above paragraphs, the first and second locking rings are disposed axially between an axial end of the piston and a surface of the first end plate.

In some configurations of the compressor of any one or more of the above paragraphs, each of the first and second locking rings include a plurality of first teeth and a plurality of second teeth.

In some configurations of the compressor of any one or more of the above paragraphs, the second teeth of the first locking ring engage the second teeth of the second locking ring.

In some configurations of the compressor of any one or more of the above paragraphs, the first teeth of the first locking ring engage the axial end of the piston.

In some configurations of the compressor of any one or more of the above paragraphs, the rotationally fixed structure includes a discharge valve disposed axially between the axial end of the piston and the surface of the first end plate.

In some configurations of the compressor of any one or more of the above paragraphs, the first teeth of the second locking ring engage the discharge valve.

In some configurations of the compressor of any one or more of the above paragraphs, the first end plate defines a recess that receives a portion of the piston and includes internal threads that threadably engage external threads of the piston.

In some configurations of the compressor of any one or more of the above paragraphs, the internal threads include a wedge ramp that engages a crest of the external threads of the piston.

In another form, the present disclosure provides a compressor that may include a shell assembly, a non-orbiting scroll, an orbiting scroll, a piston, and a piston-retention member. The shell assembly may include an end cap at least partially defining a discharge chamber and a pressure chamber. The non-orbiting scroll is disposed within the shell assembly and include a first end plate and a first spiral wrap extending from the first end plate. The orbiting scroll is disposed within the shell assembly and includes a second end plate and a second spiral wrap extending from the second end plate. The first and second spiral wraps mesh with each other to form a plurality of fluid pockets therebetween. The piston may include a main body and a flange portion extending from the main body. The main body may threadably engage the non-orbiting scroll. The flange portion may be received within a recess defined by the end cap such that the piston cooperates with the end cap to define the pressure chamber. The pressure chamber may be in selective fluid communication with a source of working fluid that is at a lower pressure than working fluid in the discharge chamber to control movement of the piston relative to the shell assembly. The piston-retention member may engage the piston and a rotationally fixed structure. The piston-retention member allows threadable rotation of the piston relative to the non-orbiting scroll in a first rotational direction and restricts rotation of the piston relative to the non-orbiting scroll in a second rotational direction that is opposite the first rotational direction.

In some configurations of the compressor of the above paragraph, the rotationally fixed structure is a partition of the shell assembly. The partition may define the discharge chamber and a suction chamber.

In some configurations of the compressor of any one or more of the above paragraphs, the piston-retention member is pivotably mounted to the partition and selectively engages one of a plurality of notches formed on the piston.

In some configurations of the compressor of any one or more of the above paragraphs, the piston-retention member is pivotably mounted to a wear ring of the partition.

In some configurations of the compressor of any one or more of the above paragraphs, the piston-retention member is pivotably mounted to the piston and selectively engages one of a plurality of notches formed on the partition.

In some configurations of the compressor of any one or more of the above paragraphs, the plurality of notches are formed on a wear ring of the partition.

In some configurations of the compressor of any one or more of the above paragraphs, the rotationally fixed structure is the end cap of the shell assembly.

In some configurations of the compressor of any one or more of the above paragraphs, the piston-retention member is pivotably mounted to the piston and selectively engages one of a plurality of notches formed on the end cap.

In some configurations of the compressor of any one or more of the above paragraphs, the piston-retention member is disposed in the pressure chamber.

In some configurations of the compressor of any one or more of the above paragraphs, a spring engages the piston-retention member and the rotationally fixed structure. The spring may bias the piston-retention member into engagement with a selected one of a plurality of notches.

In some configurations of the compressor of any one or more of the above paragraphs, the rotationally fixed structure includes the non-orbiting scroll.

In some configurations of the compressor of any one or more of the above paragraphs, the piston-retention member includes a first locking ring and a second locking ring.

In some configurations of the compressor of any one or more of the above paragraphs, the first and second locking rings are disposed axially between an axial end of the piston and a surface of the first end plate.

In some configurations of the compressor of any one or more of the above paragraphs, each of the first and second locking rings include a plurality of first teeth and a plurality of second teeth.

In some configurations of the compressor of any one or more of the above paragraphs, the second teeth of the first locking ring engage the second teeth of the second locking ring.

In some configurations of the compressor of any one or more of the above paragraphs, the first teeth of the first locking ring engage the axial end of the piston.

In some configurations of the compressor of any one or more of the above paragraphs, the rotationally fixed structure includes a discharge valve disposed axially between the axial end of the piston and the surface of the first end plate.

In some configurations of the compressor of any one or more of the above paragraphs, the first teeth of the second locking ring engage the discharge valve.

In some configurations of the compressor of any one or more of the above paragraphs, the first end plate defines a recess that receives a portion of the piston and includes internal threads that threadably engage external threads of the piston.

In some configurations of the compressor of any one or more of the above paragraphs, the internal threads include a wedge ramp that engages a crest of the external threads of the piston.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
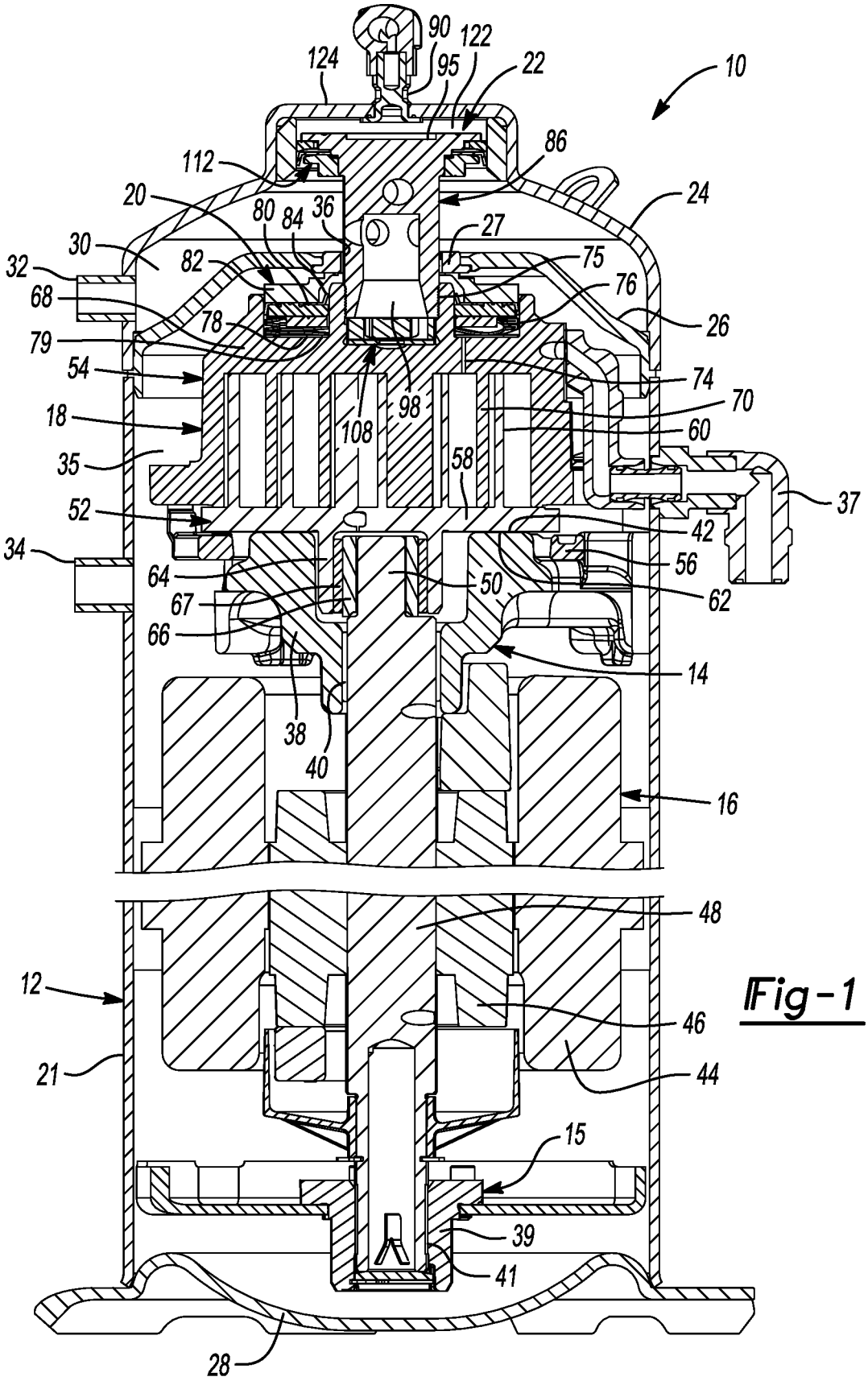
FIG. 1 is a cross-sectional view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-5, a compressor 10 is provided that may include a hermetic shell assembly 12, a first bearing housing assembly 14, a second bearing housing assembly 15, a motor assembly 16, a compression mechanism 18, a floating seal assembly 20, and a capacity modulation assembly 22. The shell assembly 12 may generally form a compressor housing and may include a cylindrical shell 21, an end cap 24 at the upper end of the shell 21, a transversely extending partition 26, and a base 28 at a lower end of the shell 21. The end cap 24 and partition 26 may generally define a discharge chamber 30. A discharge gas outlet fitting 32 may be attached to the shell assembly 12 at an opening in the end cap 24. A suction gas inlet fitting 34 may be attached to the shell assembly 12 at another opening and may communicate with a suction chamber 35 defined by the shell 21 and the partition 26. The partition 26 may include a discharge passage 36 that provides fluid communication between the compression mechanism 18 (which is disposed in the suction chamber 35) and the discharge chamber 30.

The first bearing housing assembly 14 may be affixed to the shell 21 and may include a first bearing housing 38 and a first bearing 40. The first bearing housing 38 may house the first bearing 40 therein and may define an annular flat thrust bearing surface 42 on an axial end surface thereof. The second bearing housing assembly 15 may be affixed to the shell 21 and may include a second bearing housing 39 and a second bearing 41. The second bearing housing 39 may house the second bearing 41 therein.

The motor assembly 16 may include a motor stator 44 and a rotor 46. The motor stator 44 may be attached to the shell 21 (e.g., via press fit, staking, and/or welding). The rotor 46 may be attached to a driveshaft 48 (e.g., via press fit, staking, and/or welding). The driveshaft 48 may be driven by the rotor 46 and may be supported by the first and second bearings 40, 41 for rotation relative to the shell assembly 12. In some configurations, the motor assembly 16 is a variablespeed motor. In other configurations, the motor assembly 16 could be a multi-speed motor or a fixed-speed motor.

The compression mechanism 18 may generally include an orbiting scroll 52, a non-orbiting scroll 54 and an Oldham coupling 56. The orbiting scroll 52 may include an end plate 58 having a spiral wrap 60 on the upper surface thereof and an annular flat thrust surface 62 on the lower surface. The thrust surface 62 may interface with the annular flat thrust bearing surface 42 on the first bearing housing 38. A cylindrical hub 64 may project downwardly from the thrust surface 62 and may have a drive bushing 66 rotatably disposed therein. A drive bearing 67 may be disposed within the hub 64 and may surround the drive bushing 66. The drive bushing 66 may include an inner bore in which an eccentric crank pin 50 of the driveshaft 48 is drivingly disposed. A flat surface of the crankpin 50 may drivingly engage a flat surface in a portion of the inner bore of the drive bushing 66 to provide a radially compliant driving arrangement. The Oldham coupling 56 may be engaged with the orbiting and non-orbiting scrolls 52, 54 or with the orbiting scroll 52 and the first bearing housing 38 to prevent relative rotation therebetween.

The non-orbiting scroll 54 may include an end plate 68 and a spiral wrap 70 projecting downwardly from the end plate 68. The spiral wrap 70 may meshingly engage the spiral wrap 60 of the orbiting scroll 52, thereby creating a series of moving compression pockets. The compression pockets defined by the spiral wraps 60, 70 may decrease in volume as they move from a radially outer position (at a suction pressure) to a radially intermediate position (at an intermediate pressure) to a radially inner position (at a discharge pressure) throughout a compression cycle of the compression mechanism 18.

The end plate 68 may include a discharge passage 72 (FIG. 2), an intermediate passage 74 (FIG. 1), a central recess 75 (FIGS. 1 and 2), and an annular recess 76 (FIGS. 1 and 2) that surrounds the central recess 75. The discharge passage 72 is in communication with one of the fluid pockets at the radially inner position and allows compressed working fluid (e.g., at the discharge pressure) to flow into the discharge chamber 30. The intermediate passage 74 may provide fluid communication between one of the fluid pockets at the radially intermediate position and the annular recess 76. The annular recess 76 may receive the floating seal assembly 20 and cooperate with the floating seal assembly 20 to define an axial biasing chamber 78 therebetween. The axial biasing chamber 78 receives fluid from the fluid pocket in the intermediate position through the intermediate passage 74. A pressure differential between the intermediate-pressure fluid in the biasing chamber 78 and fluid in the suction chamber 35 exerts an axial biasing force on the non-orbiting scroll 54 urging the non-orbiting scroll 54 in an axial direction (i.e., in a direction along a rotational axis of the driveshaft 48) toward the orbiting scroll 52 to sealingly engage the scrolls 52, 54 with each other. In some configurations, one or more springs 79 may be disposed within the axial biasing chamber 78 between the floating seal assembly 20 and the end plate 68 and may urge the non-orbiting scroll 54 in the axial direction toward the orbiting scroll 52 to sealingly engage the scrolls 52, 54 with each other.

The floating seal assembly 20 may be at least partially disposed within the annular recess 76 and may seal off the axial biasing chamber 78 from the discharge chamber 30 and the suction chamber 35 and seal off the suction chamber 35 from the discharge chamber 30 will still allowing the non-orbiting scroll 54 to move in the axial direction relative to the orbiting scroll 52. The floating seal assembly 20 may include an annular base plate 80, a first annular sealing member 82, and a second annular sealing member 84. The annular base plate 80 may be fixed to the first annular sealing member 82 with the second annular sealing member 84 sandwiched therebetween. The first annular sealing member 82 may sealingly engage the partition 26 (e.g., a wear ring 27 of the partition 26 that defines the discharge passage 36). The second annular sealing member 84 may sealingly engage surfaces of the non-orbiting scroll 54 that define radially inner and outer diameters of the annular recess 76. It will be appreciated that the floating seal assembly 20 could be configured in a variety of other ways that are known in the art. For example, in some configurations, the floating seal assembly 20 could be a one-piece annular member.

The capacity modulation assembly 22 may be operable to selectively switch the compressor 10 between a full capacity mode and a reduced capacity mode. To operate the compressor 10 in the full capacity mode, the capacity modulation assembly 22 may axially bias the non-orbiting scroll 54 into sealing engagement with the orbiting scroll 52. To operate the compressor 10 in the reduced capacity mode, the capacity modulation assembly 22 may cause the non-orbiting scroll 54 to move axially away from the orbiting scroll 52 to axially separate the non-orbiting scroll 54 from the orbiting scroll 52 to allow compression pockets to leak into the suction chamber 35.

Figure 3:
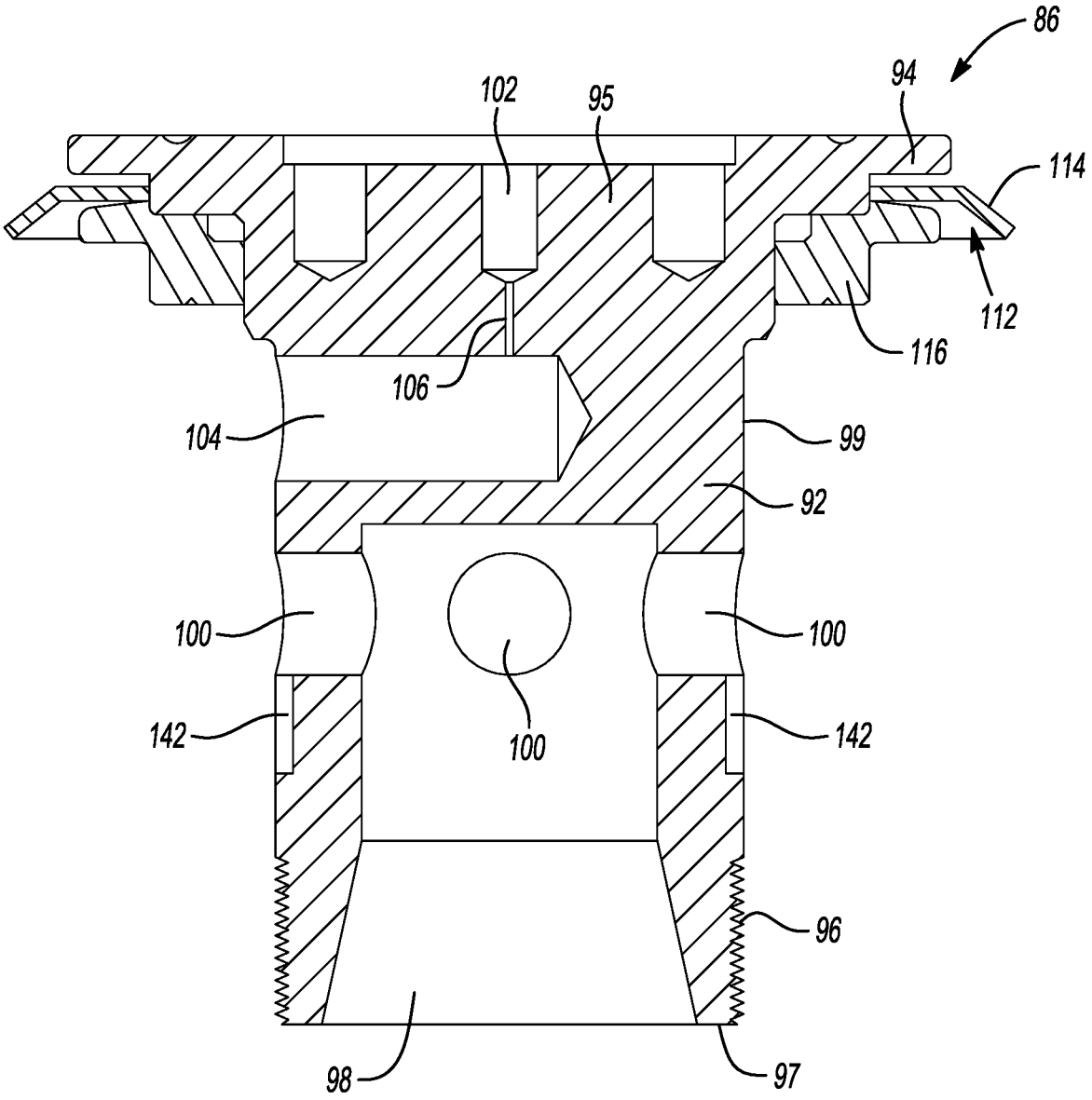
FIG. 3 is a cross-sectional view of a piston of a capacity modulation assembly of the compressor.

The capacity modulation assembly 22 may include a piston 86 and a capacity-modulation fitting 90. As shown in FIG. 3, the piston 86 may include a generally cylindrical main body 92 and a flange portion 94. The flange portion 94 may be disposed at a first axial end 95 of the main body 92 and may extend radially outward from the first axial end 95. Threads 96 may be formed on an outer diametrical surface 99 of the main body 92 at or proximate a second axial end 97 of the main body 92. The main body 92 may include an axially extending discharge passage 98 that extends in an axial direction (i.e., along a longitudinal axis of the main body 92) through the first axial end 95 and through a portion of the main body 92. One or more radially extending passages 100 may extend from the axially extending discharge passage 98 through the outer diametrical surface 99 of the main body 92.

A first aperture 102 may extend through the first axial end 95 of the main body 92. A second aperture 104 may extend radially through the outer diametrical surface 99 of the main body 92 at a location axially between the passages 100 and the first aperture 102. An orifice 106 may provide fluid communication between the first and second apertures 102, 104. The orifice 106 may have a diameter that is substantially smaller than diameters of the first and second apertures 102, 104. The diameter of the orifice 106 may be selected to limit a flow rate of fluid flowing between the first and second apertures 102, 104.

Figure 2:
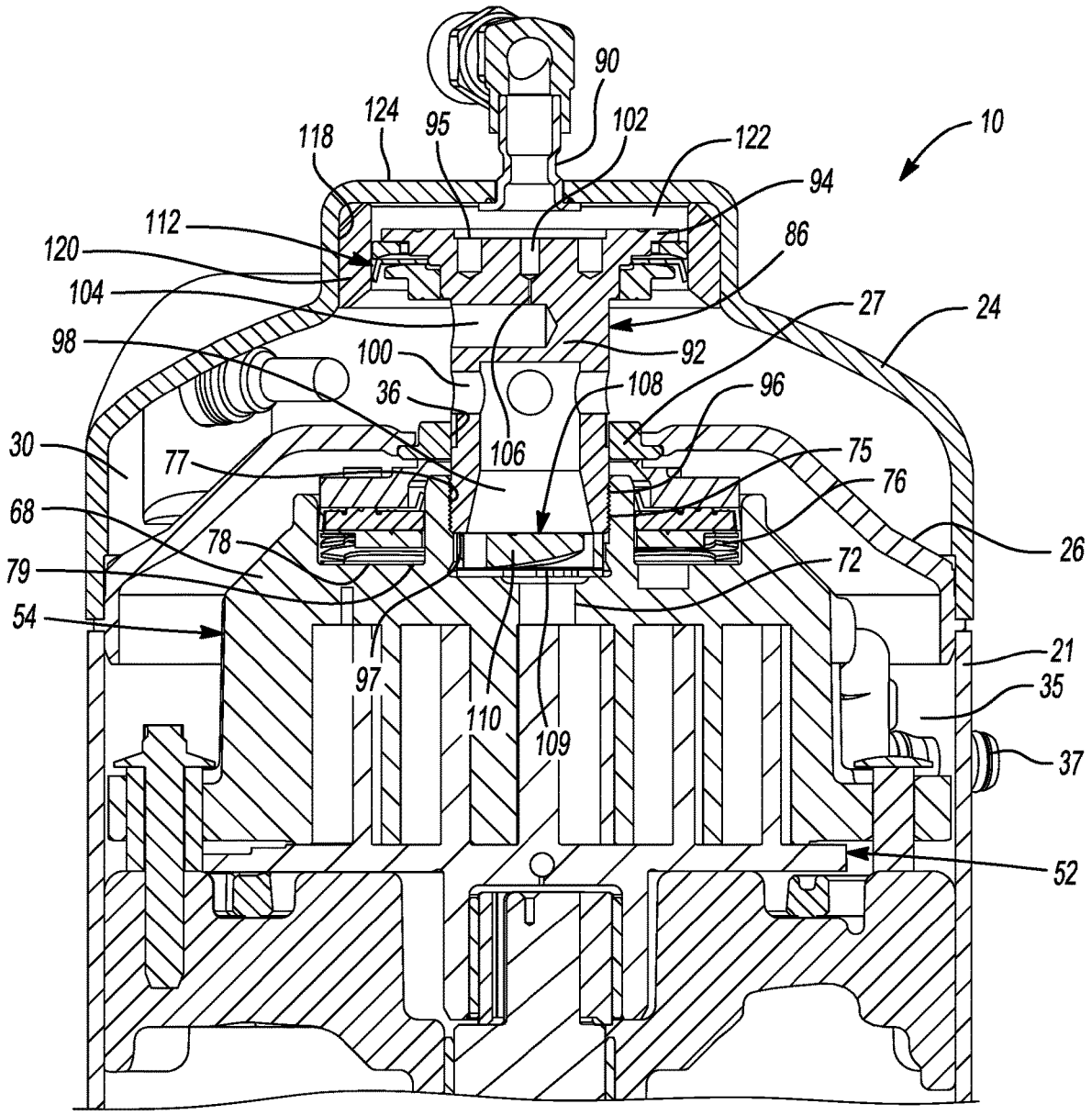
FIG. 2 is a partial cross-sectional view of the compressor of FIG. 1.

As shown in FIG. 2, the main body 92 of the piston 86 extends through the discharge passage 36 (defined by the wear ring 27 of the partition 26) and the second axial end 97 of the main body 92 of the piston 86 is threadably received in the central recess 75 of the non-orbiting scroll 54 (i.e., the threads 96 of the piston 86 are engaged with corresponding threads 77 on the non-orbiting scroll 54). A discharge valve 108 (including, for example, a reed valve 109 and a valve backer 110) may be disposed within the central recess 75 between the discharge passage 72 of the non-orbiting scroll 54 and the second axial end 97 of the main body 92 of the piston 86. The valve backer 110 may be attached to the end plate 68 by pins and/or threaded fasteners, for example. The discharge valve 108 allows fluid flow from the discharge passage 72 of the non-orbiting scroll 54 to the discharge passage 98 of the piston 86 and restricts fluid flow from the discharge passage 98 to the discharge passage 72. The discharge passage 98 of the piston 86 is in fluid communication with the discharge chamber 30 via the passages 100. In this manner, compressed working fluid can be discharged from the compression mechanism 18 by flowing through the discharge passage 72, through the discharge valve 108, through the discharge passage 98, through the passages 100, and into the discharge chamber 30.

An annular seal assembly 112 may engage the flange portion 94 of the piston 86. The seal assembly 112 may include an annular lip seal 114 and one or more annular retainers 116. The lip seal 114 and retainer 116 may encircle the first axial end 95 of the main body 92 of the piston 86. The retainer 116 may engage the piston 86 (e.g., by press fit, shrink fit, and/or fasteners) and the lip seal 114 may be sandwiched between the retainer 116 and the flange portion 94 of the piston 86.

As shown in FIG. 2, the end cap 24 of the shell assembly 12 may define a generally cylindrical recess 118 that fixedly receives an annular recess fitting 120. The first axial end 95 of the main body 92 of the piston 86 and the flange portion 94 of the piston 86 may be slidably received in the recess 118 (e.g., slidably received in the recess fitting 120 so that the piston 86 can move in an axial direction (i.e., a direction along or parallel to the longitudinal axis of the piston 86) relative to the end cap 24 and recess fitting 120). The seal assembly 112 sealingly engages the recess fitting 120 and the piston 86 so that a pressure chamber 122 is formed within the recess 118 between the first axial end 95 of the piston 86 and an end wall 124 of the end cap 24.

The capacity-modulation fitting 90 may extend through the end wall 124 of the end cap 24 and may be in fluid communication with the pressure chamber 122. The pressure chamber 122 may also be in fluid communication with the discharge chamber 30 via the first and second apertures 102, 104 and the orifice 106.

Figure 7:
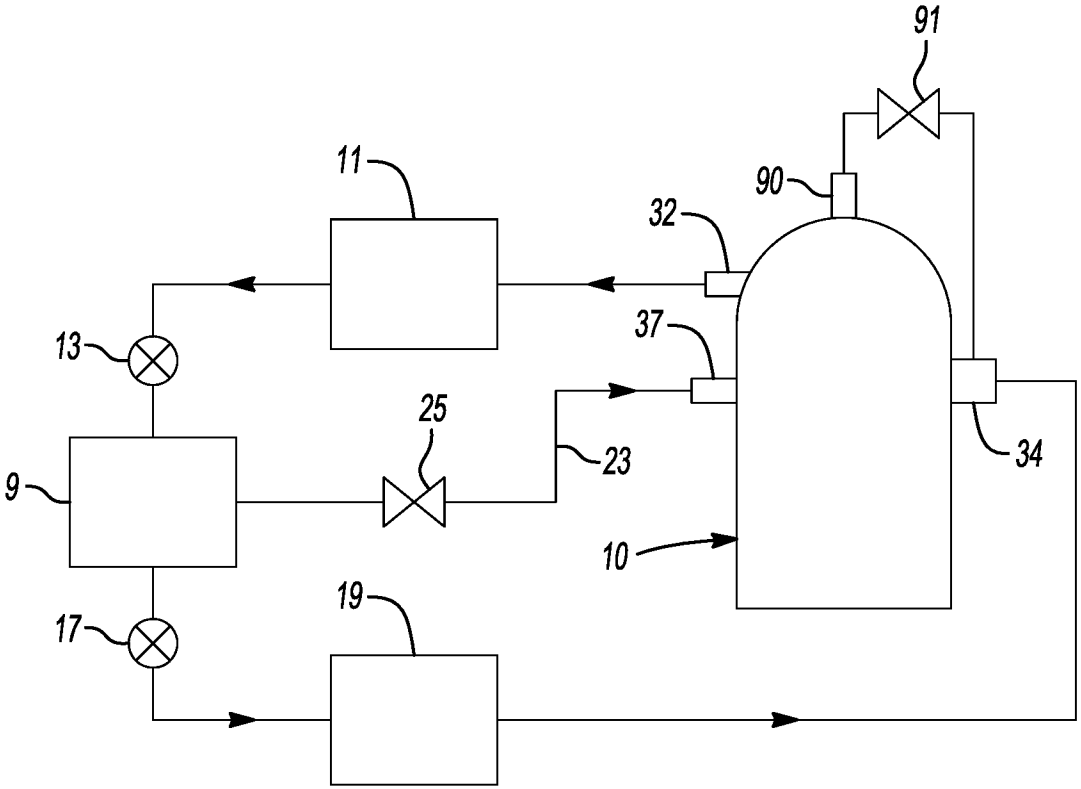
FIG. 7 is a schematic representation of a climate-control system in which the compressor is installed.

FIG. 7 shows an example of a climate-control system in which the compressor 10 may be installed. In addition to the compressor 10, the climate-control system may include an outdoor heat exchanger (e.g., a condenser) 11, a first expansion device (e.g., an expansion valve or capillary tube) 13, a flash tank or an economizer 9, a second expansion device (e.g., an expansion valve or capillary tube) 17, and an indoor heat exchanger (e.g. an evaporator) 19. During operation of the compressor 10, working fluid is compressed by the compression mechanism 18 and is discharged from the compressor 10 through the discharge fitting 32. The compressed working fluid may flow from the discharge fitting 32 to the outdoor heat exchanger 11, where heat from the working fluid may be transferred to ambient air (or to another cooling fluid). From the outdoor heat exchanger 11, the working fluid may flow through the first expansion device 13, where the pressure of the working fluid is reduced.

From the first expansion device 13, the working fluid may flow into the flash tank 9. A first portion of the fluid in the flash tank 9 (e.g., vapor working fluid) may flow through a fluid-injection conduit 23 that may be coupled to a fluid-injection inlet fitting 37 of the compressor 10. The fluid-injection inlet fitting 37 may be in fluid communication with an intermediate-pressure compression pocket (i.e., a pocket that is at a radially intermediate position) of the compression mechanism 18. A control valve 25 (e.g., a solenoid valve) may control fluid flow through the fluid-injection conduit 23.

A second portion of the fluid in the flash tank 9 (e.g., liquid working fluid) may flow through the second expansion device 17, wherein its pressure is further reduced, From the second expansion device 17, the working fluid may flow through the indoor heat exchanger 19, where the working fluid may absorb heat from a space to be cooled. From the indoor heat exchanger 19, the working fluid may flow back into the compressor 10 through the suction gas inlet fitting 34.

The capacity-modulation fitting 90 of the compressor 10 may be in fluid communication with a source of reduced-pressure working fluid (e.g., working fluid at a lower pressure than discharge pressure). The source of reduced-pressure working fluid may be a source of intermediate-pressure working fluid (e.g., the flash tank or economizer 9 or the fluid-injection conduit 23 or fitting 37) or a source of suction-pressure working fluid (e.g., the suction chamber 35, suction gas inlet fitting 34, or a suction conduit extending between the indoor heat exchanger 19 and the suction gas inlet fitting 34). A capacity-modulation control valve 91 (FIG. 7) may be fluidly coupled to the capacity-modulation fitting 90 and may be selectively opened and closed to allow and prevent fluid communication between the pressure chamber 122 (FIGS. 1 and 2) and the source of reduced-pressure working fluid to switch the compressor 10 between the full capacity mode and the reduced capacity mode.

To axially bias the non-orbiting scroll 54 into sealing engagement with the orbiting scroll 52 for full capacity operation, the capacity-modulation control valve 91 may be moved to a first position by a control module to block fluid flow between the pressure chamber 122 and the source of reduced-pressure working fluid. By blocking fluid communication between the pressure chamber 122 and the source of reduced-pressure working fluid, the fluid pressure within the pressure chamber 122 will raise to that of the discharge chamber 30 due to the fluid communication between the pressure chamber 122 and the discharge chamber 30 via the first and second apertures 102, 104 and orifice 106. When the fluid pressures within the pressure chamber 122 and the discharge chamber 30 are equal or close to equal, the axial biasing force exerted by the intermediate pressure working fluid in the axial biasing chamber 78 will axially bias the non-orbiting scroll 54 into sealing engagement with the orbiting scroll 52.

To switch the compressor 10 to the reduced-capacity mode, the capacity-modulation control valve 91 may be moved to a second position by the control module to allow fluid communication between the pressure chamber 122 and the source of reduced-pressure working fluid. By allowing fluid communication between the pressure chamber 122 and the source of reduced-pressure working fluid, the fluid pressure within the pressure chamber 122 will be reduced due to the fluid communication between the pressure chamber 122 and the source of reduced-pressure working fluid. When the fluid pressure within the pressure chamber 122 is reduced relative to the fluid pressure of the discharge chamber 30, the higher pressure working fluid in the discharge chamber 30 will push the piston 86 axially toward the end wall 124 (i.e., away from the orbiting scroll 52), which causes the non-orbiting scroll 54 to move axially away from the orbiting scroll 52, thereby axially separating the non-orbiting scroll 54 from the orbiting scroll 52 to allow the compression pockets to leak into the suction chamber 35.

Figure 4:
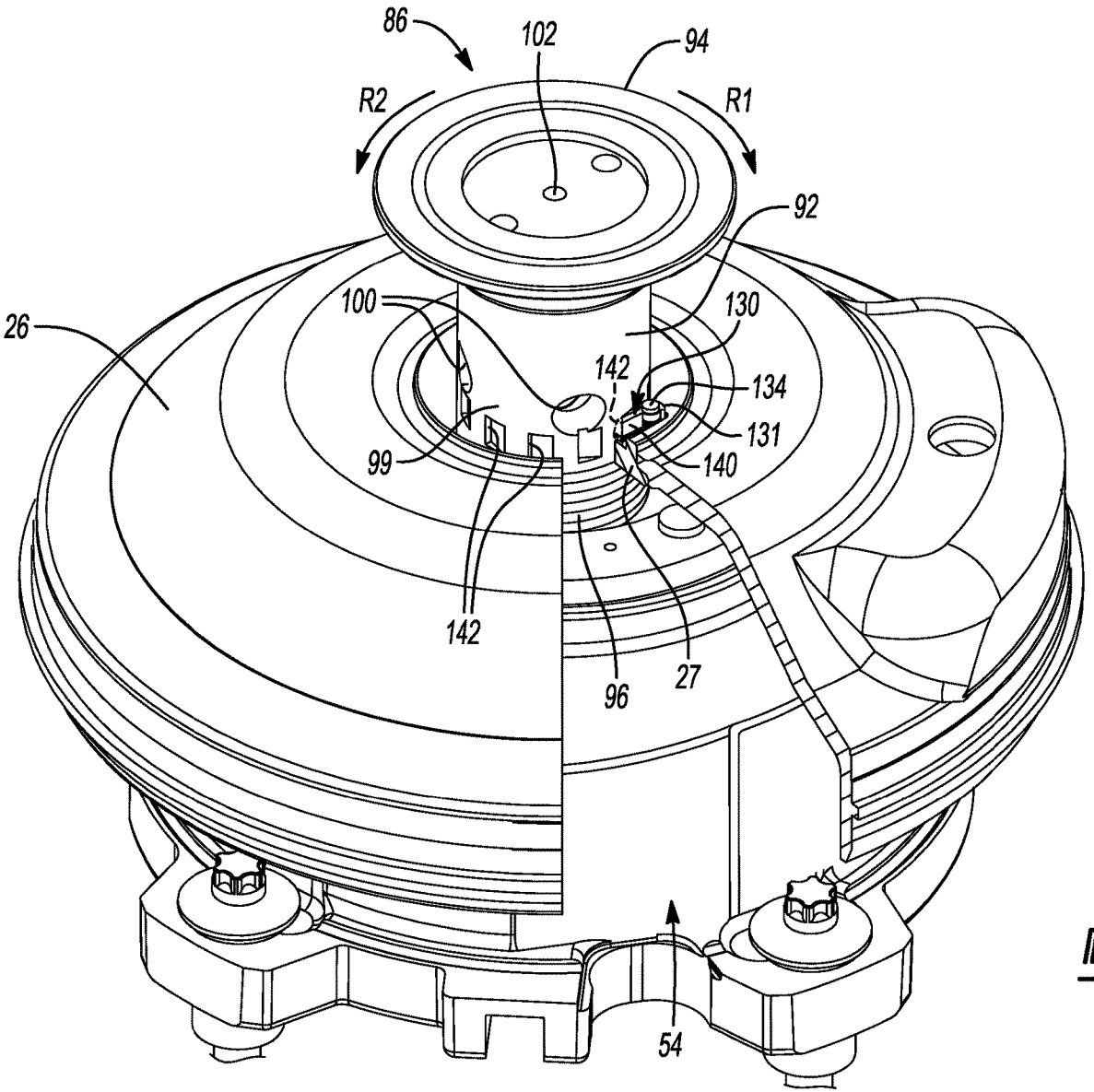
FIG. 4 is a partially cut away perspective view of the piston, a partition, a non-orbiting scroll, and a piston-retention member according to the principles of the present disclosure.
Figure 5:
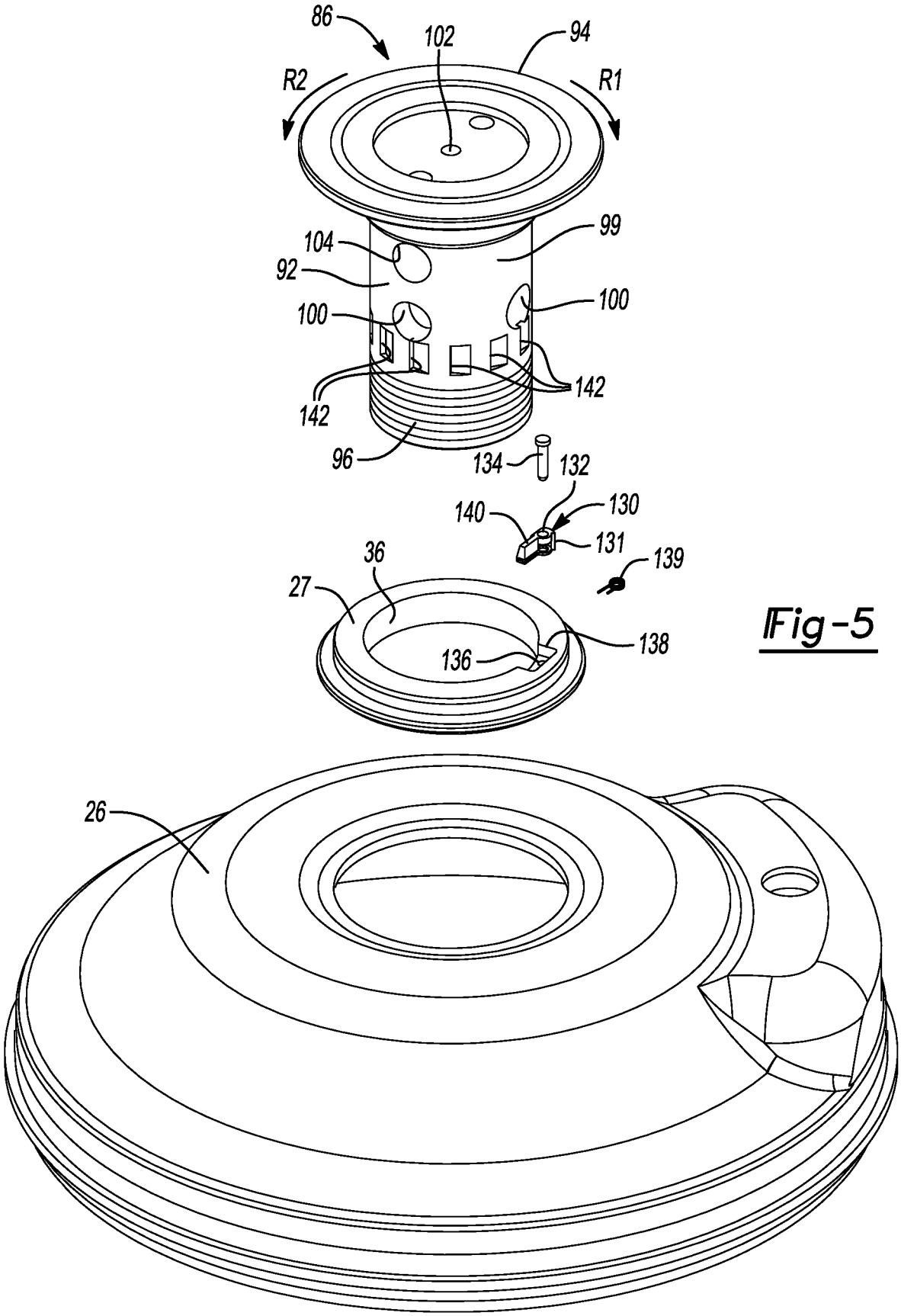
FIG. 5 is an exploded view of the piston, piston-retention member, wear ring, and partition.
Figure 6:
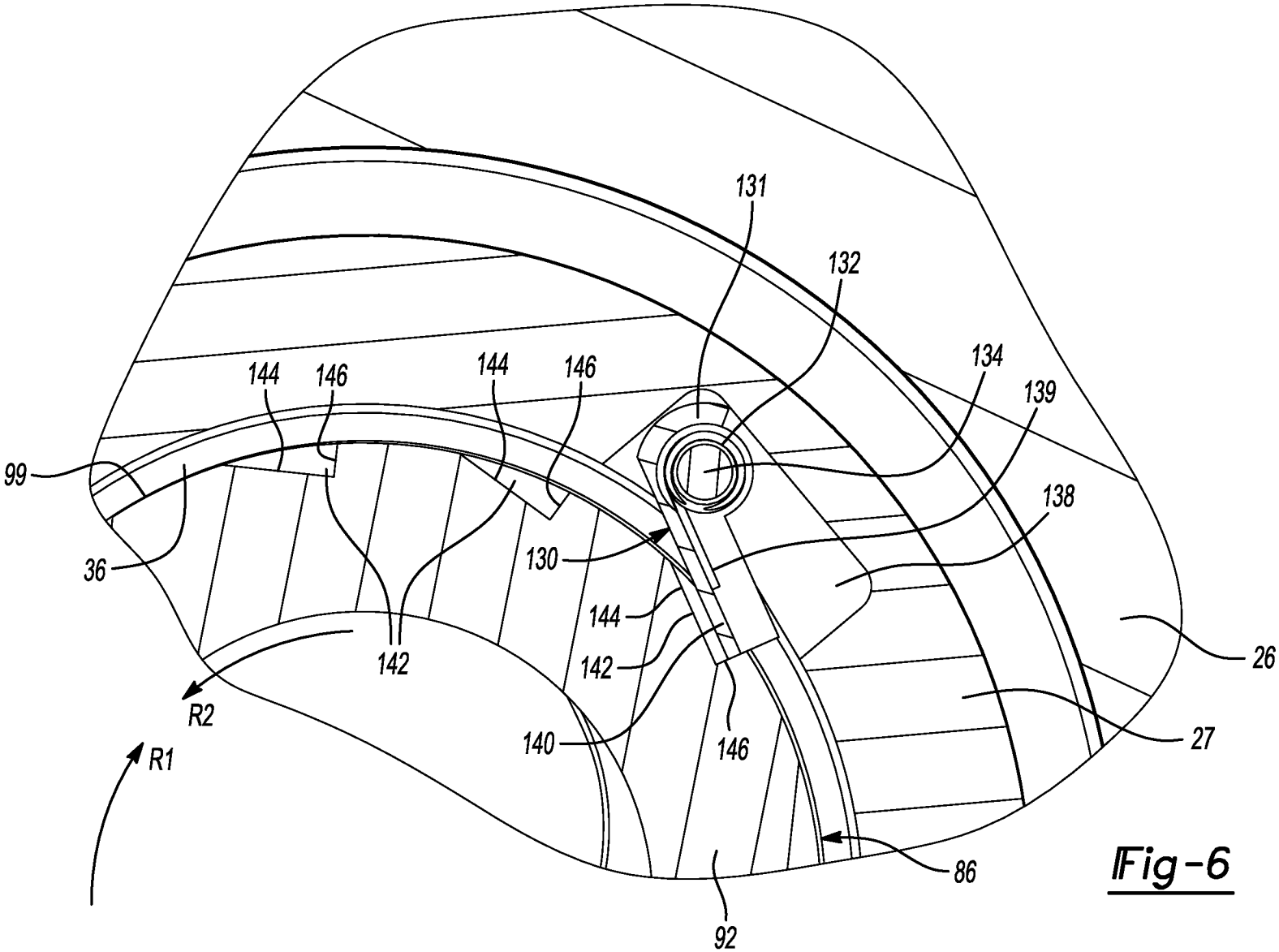
FIG. 6 is a partial cross-sectional view of the piston, the wear ring, and the piston-retention member engaging a notch in the piston.

Referring now to FIGS. 4-6, a piston-retention member 130 may engage the piston 86 and a rotationally fixed structure within the compressor 10, such as a component of the shell assembly 12 (e.g., the partition 26 or end cap 24) or the non-orbiting scroll 54 in a manner that (a) allows the piston 86 to be rotated relative to the non-orbiting scroll 54 in a first rotational direction R1 to threadably inserted the piston 86 into the central recess 75, and (b) restricts rotation of the piston 86 relative to the non-orbiting scroll 54 in a second rotational direction R2 (opposite the first rotational direction) that threadably loosens the piston 86 relative to the non-orbiting scroll 54. In other words, the piston-retention member 130 allows the piston 86 to be threaded into the non-orbiting scroll 54 while preventing the piston 86 from threadably loosening or backing out of the non-orbiting scroll 54. The piston-retention member 130 also allows the piston 86 to move in the axial direction to switch the compressor 10 between the full capacity and reduced capacity modes, as described above.

In the configuration shown in FIGS. 4-6, the piston-retention member 130 may be a tab, lever, or protrusion that is hingedly mounted to the partition 26 (e.g., the wear ring 27 of the partition 26). A first end 131 of the piston-retention member 130 may include an aperture 132 (FIGS. 5 and 6) that receives a pin 134 or other fastener. The pin 134 may also be received in an aperture 136 formed in the wear ring 27 to attach the piston-retention member 130 to the wear ring 27. The piston-retention member 130 is rotatable relative to the wear ring 27 about a rotational axis defined by the pin 134.

As shown in FIGS. 5 and 6, the wear ring 27 may include a recess 138 that can movably receive at least a portion of the piston-retention member 130. The first end 131 of the piston-retention member 130 and the pin 134 may be received in the recess 138. A torsion spring 139 (FIGS. 5 and 6) may engage the piston-retention member 130 and a wall of the recess 138 and may rotationally bias a second end 140 of the piston-retention member 130 into engagement with the piston 86.

The main body 92 of the piston 86 may include a plurality of detents or notches 142 formed in the outer diametrical surface 99 of the main body 92. The notches 142 may be arranged in a circular pattern that extends around the circumference of the main body 92. As shown in FIG. 6, each of the notches 142 may include a ramped or sloped surface 144 and an end wall 146.

As shown in FIG. 6, the second end 140 of the piston-retention member 130 can be received in any of the notches 142 and may abut the end wall 146. Interference between the piston-retention member 130 and the end wall 146 prevents the piston 86 from rotating relative to the wear ring 27 (and relative to the non-orbiting scroll 54) in the second rotational direction R2. The piston-retention member 130 allows the piston 86 to rotate relative to the wear ring 27 and non-orbiting scroll 54 in the first rotational direction R1 because as the piston 86 rotates in the first rotational direction R1, the ramped surface 144 slides along the piston-retention member 130 and pushes the second end 140 of the piston-retention member 130 outward toward the wear ring 27. In this manner, the piston-retention member 130 and notches 142 function as a ratchet to allow threaded tightening of the piston 86 within the non-orbiting scroll 54 and restrict threaded loosening of the piston 86 relative to the non-orbiting scroll 54. It will be appreciated that, instead of the notches 142, the piston 86 could include teeth or ramped protrusions that extend outward to engage the piston-retention member 130.

Figure 8:
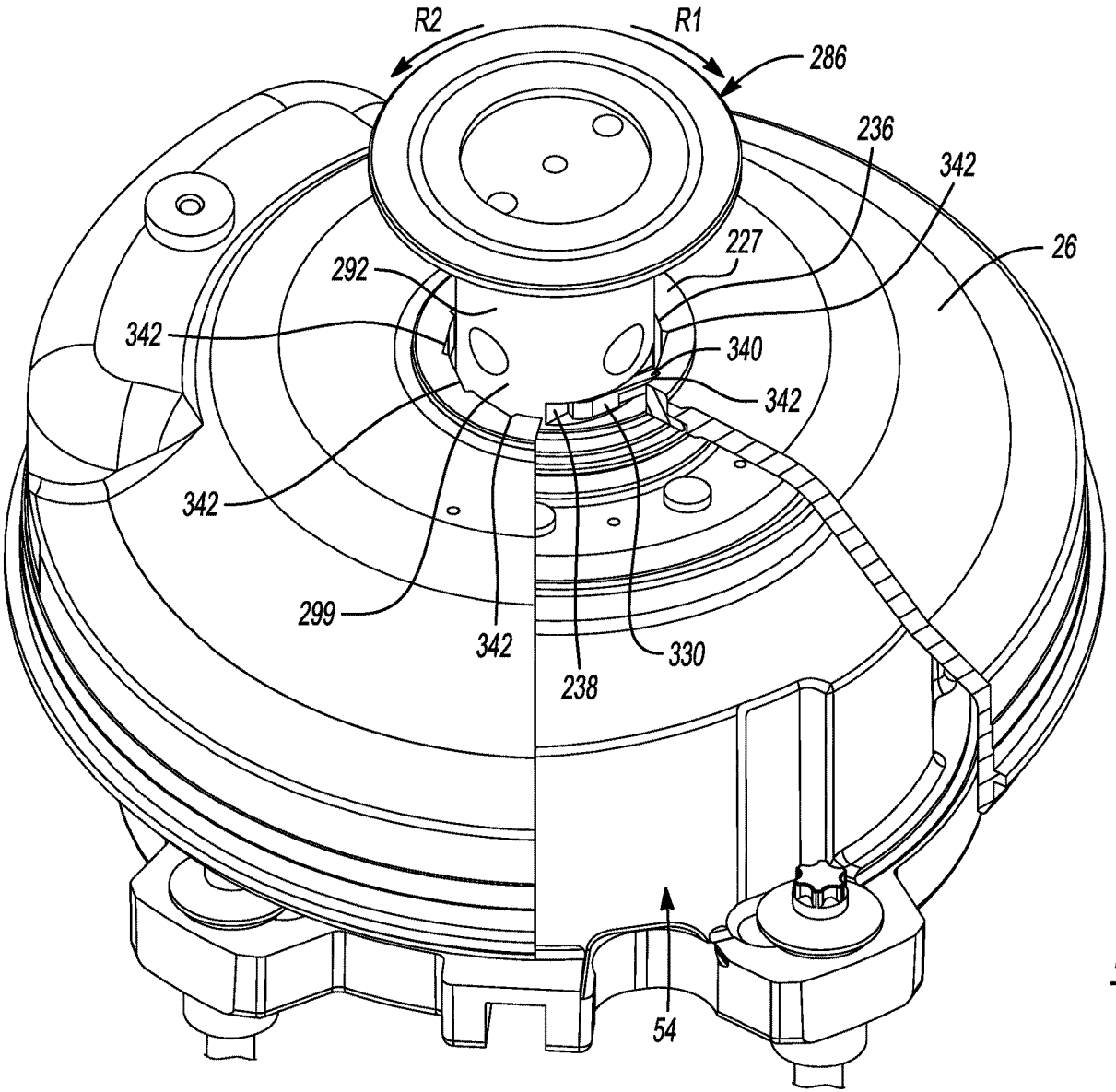
FIG. 8 is a partially cut away perspective view of an alternative piston, alternative partition, the non-orbiting scroll, and an alternative piston-retention member according to the principles of the present disclosure.
Figure 9:
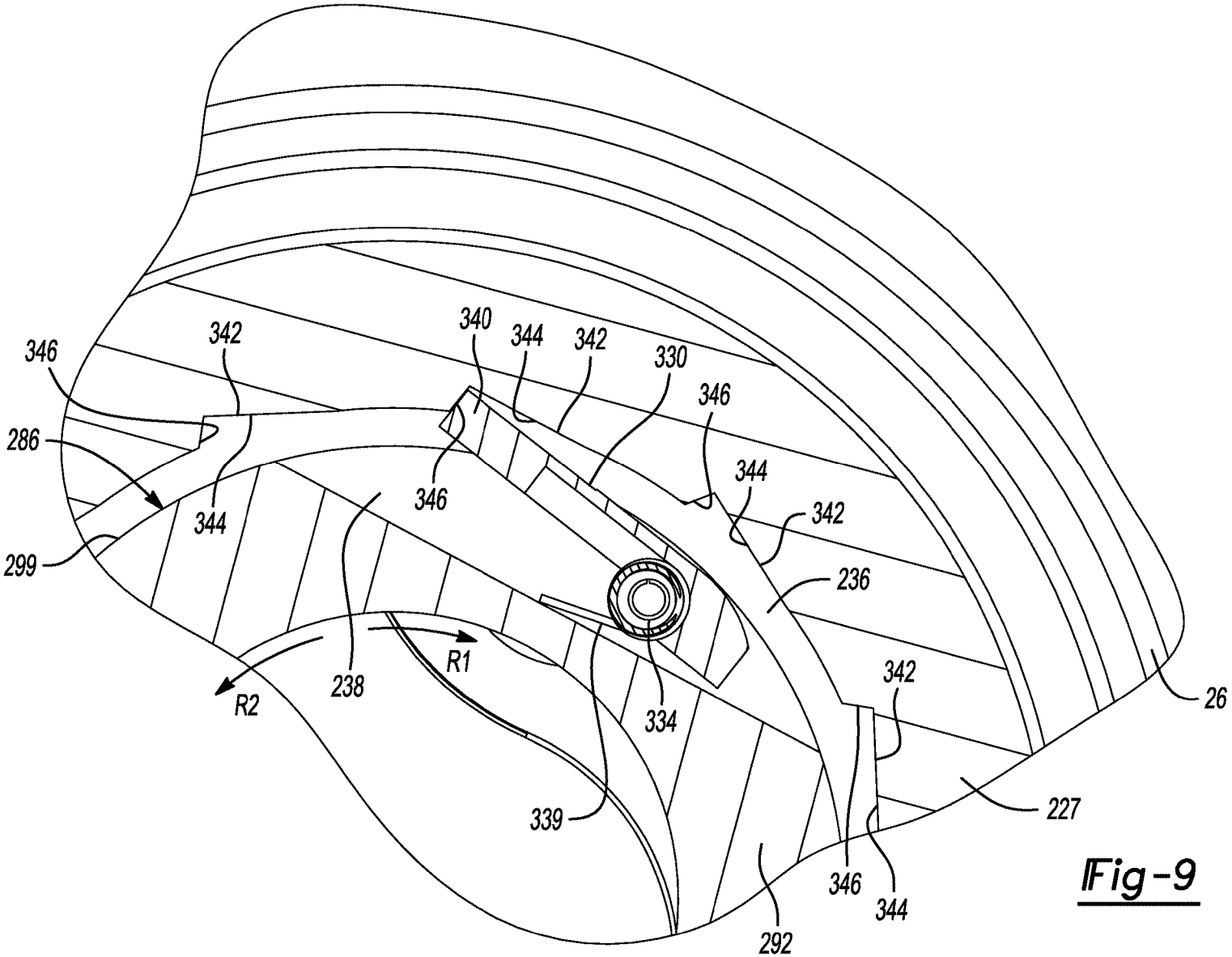
FIG. 9 is a partial cross-sectional view of the piston, the wear ring, and the piston-retention member of FIG. 8.

Referring now to FIGS. 8 and 9, an alternative piston 286, an alternative wear ring 227, and an alternative piston-retention member 330 are provided that can be incorporated into the compressor 10 instead of the piston 86, wear ring 27, and piston-retention member 130 described above. The structure and function of the piston 286, wear ring 227, and piston-retention member 330 may be similar or identical to that of the piston 86, wear ring 27, and piston-retention member 130 described above, apart from differences described below and/or shown in the drawings. Therefore, some similar features will not be described again in detail.

Like the piston 86, the piston 286 includes a main body 292 that extends through a discharge passage 236 defined by the wear ring 227. The main body 292 includes threads that threadably engage mating threads of the non-orbiting scroll 54, as described above. A recess 238 may be formed in an outer diametrical surface 299 of the main body 292. The piston-retention member 330 may be at least partially received in the recess 238 and may be pivotably mounted (e.g., via pin 334 (like pin 134)) to the main body 292. A spring 339 (like spring 139) engages the main body 292 and the piston-retention member 330 and rotationally biases an end 340 of the piston-retention member 330 outward toward the wear ring 227.

The wear ring 227 may include a plurality of detents or notches 342. Like the notches 142, the notches 342 may include a sloped or ramped surface 344 and an end wall 346. The notches 342 may be arranged in a circular pattern that extends around the inner diametrical surface of the wear ring 227.

As shown in FIG. 9, the end 340 of the piston-retention member 330 can be received in any of the notches 342 and may abut the end wall 346. Interference between the piston-retention member 330 and the end wall 346 prevents the piston 286 from rotating relative to the wear ring 227 (and relative to the non-orbiting scroll 54) in the second rotational direction R2. The piston-retention member 330 allows the piston 286 to rotate relative to the wear ring 227 and non-orbiting scroll 54 in the first rotational direction R1 because as the piston 286 rotates in the first rotational direction R1, the piston-retention member 330 slides along the ramped surface 344 and the ramped surface 344 pushes the second end 340 of the piston-retention member 330 inward toward the main body 292. In this manner, the piston-retention member 330 and notches 342 function as a ratchet to allow threaded tightening of the piston 286 within the non-orbiting scroll 54 and restrict threaded loosening of the piston 286 relative to the non-orbiting scroll 54. It will be appreciated that, instead of the notches 342, the wear ring 227 could include teeth or ramped protrusions that extend inward to engage the piston-retention member 330.

Figure 10:
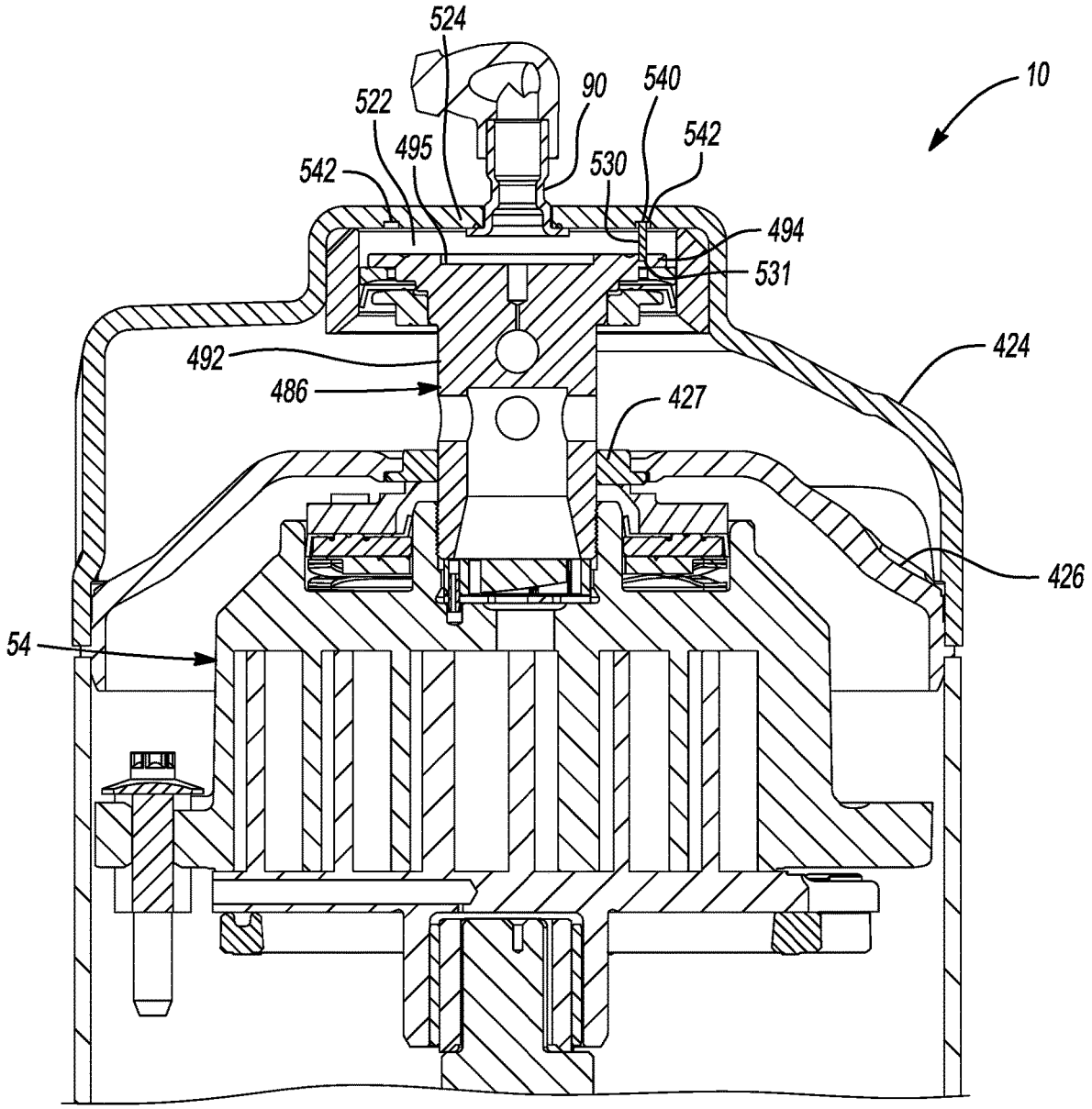
FIG. 10 is a partial cross sectional view of the compressor having another alternative piston, another alternative partition, an alternative end cap, and another alternative piston-retention member according to the principles of the present disclosure.

Referring now to FIG. 10, an alternative piston 486, an alternative wear ring 427, an alternative piston-retention member 530, and an alternative end cap 424 are provided that can be incorporated into the compressor 10 instead of the piston 86, wear ring 27, piston-retention member 130, and end cap 24 described above. The structure and function of the piston 486, wear ring 427, piston-retention member 530, and end cap 424 may be similar or identical to that of the piston 86, wear ring 27, piston-retention member 130, and end cap 24 described above, apart from differences described below and/or shown in the drawings. Therefore, some similar features will not be described again in detail.

Like the piston 86, the piston 486 includes a main body 492 that extends through a discharge passage 436 defined by the wear ring 427. The main body 492 includes threads that threadably engage mating threads of the non-orbiting scroll 54, as described above.

Instead of being mounted to extend radially outward from an outer diametrical surface of the main body 492 of the piston 486 or mounted to extend radially inward from the wear ring 427, the piston-retention member 530 may be pivotably mounted to a flange portion 494 (like the flange portion 94) of the piston 486 (as shown in FIG. 10) or to an axial end 495 of the piston 486 adjacent the flange portion 494. A first end 531 of the piston-retention member 530 may be attached to the piston 486 via a pin (like the pin 134). The piston-retention member 530 may extend from the piston 486 toward an end wall 524 of the end cap 424 (e.g., the end wall defining pressure chamber 522 (like pressure chamber 122)). A second end 540 of the piston-retention member 530 may selectively engage one of a plurality of detents or notches 542 (like notches 142, 342) formed in the end wall 524 of the end cap 424. The plurality of notches 542 may be arranged in a circular pattern that is centered on a longitudinal axis of the main body 492 of the piston 486.

Interference between the piston-retention member 530 and an end wall (like end wall 146, 346) of one of the notches 542 prevents the piston 486 from rotating relative to the end cap 424 (and relative to the non-orbiting scroll 54) in the second rotational direction R2. The piston-retention member 530 allows the piston 486 to rotate relative to the end cap 424 and non-orbiting scroll 54 in the first rotational direction R1 because as the piston 486 rotates in the first rotational direction R1, the piston-retention member 530 slides along a ramped surface (like ramped surface 144, 344) of the notch 542 and the ramped surface pushes the second end 540 of the piston-retention member 530 toward the piston 486. In this manner, the piston-retention member 530 and notches 542 function as a ratchet to allow threaded tightening of the piston 486 within the non-orbiting scroll 54 and restrict threaded loosening of the piston 486 relative to the non-orbiting scroll 54. It will be appreciated that, instead of the notches 542, the end cap 424 could include teeth or ramped protrusions that engage the piston-retention member 530. Furthermore, in some embodiments, the piston-retention member 530 could be pivotably mounted to the end cap 424 and selectively engage notches 542 formed in the piston 486 to restrict rotation of the piston 486 in the second rotational direction R2 while allowing rotation of the piston in the first rotational direction R1.

Figure 11:
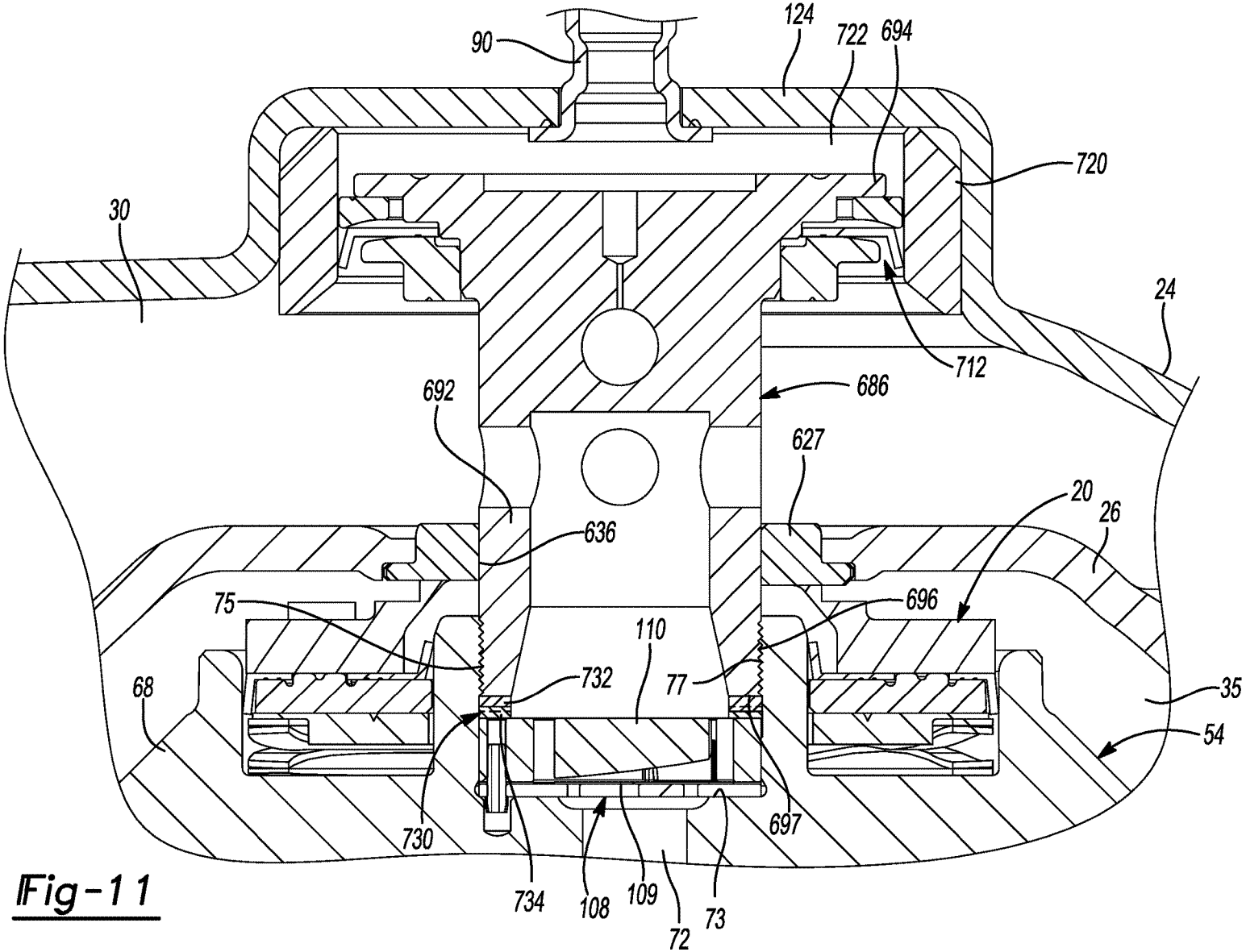
FIG. 11 is a partial cross-sectional view of the compressor having yet another alternative piston and locking rings according to the principles of the present disclosure.

Referring now to FIG. 11, an alternative piston 686, an alternative wear ring 627, and an alternative piston-retention member 730 are provided that can be incorporated into the compressor 10 instead of the piston 86, wear ring 27, and piston-retention member 130 described above. The structure and function of the piston 686, wear ring 627, and piston-retention member 730 may be similar or identical to that of the piston 86, wear ring 27, and piston-retention member 130 described above, apart from differences described below and/or shown in the drawings. Therefore, some similar features will not be described again in detail.

Like the piston 86, the piston 686 includes a main body 692 and a flange portion 694. The main body 692 extends through a discharge passage 636 defined by the wear ring 627. The main body 692 includes threads 696 that threadably engage mating threads 77 of the non-orbiting scroll 54, as described above. An annular seal assembly 712 (similar or identical to seal assembly 112) may sealingly engage the flange portion 694 of the piston 686 and sealingly engage a recess fitting 720 so that a pressure chamber 722 is formed within the recess 118 of the end cap 24, as described above.

Figure 12:
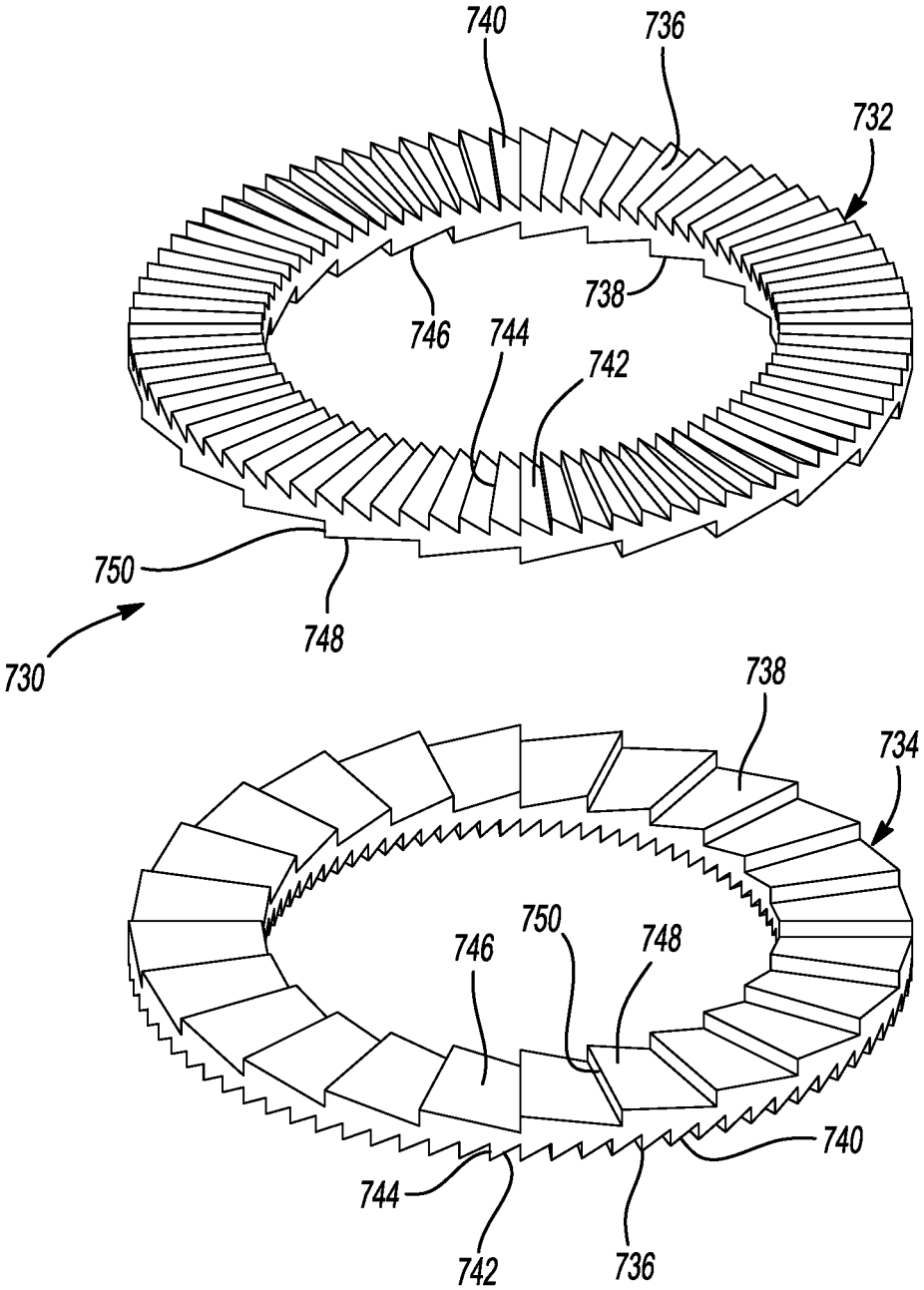
FIG. 12 is a perspective view of the locking rings.
Figure 13:
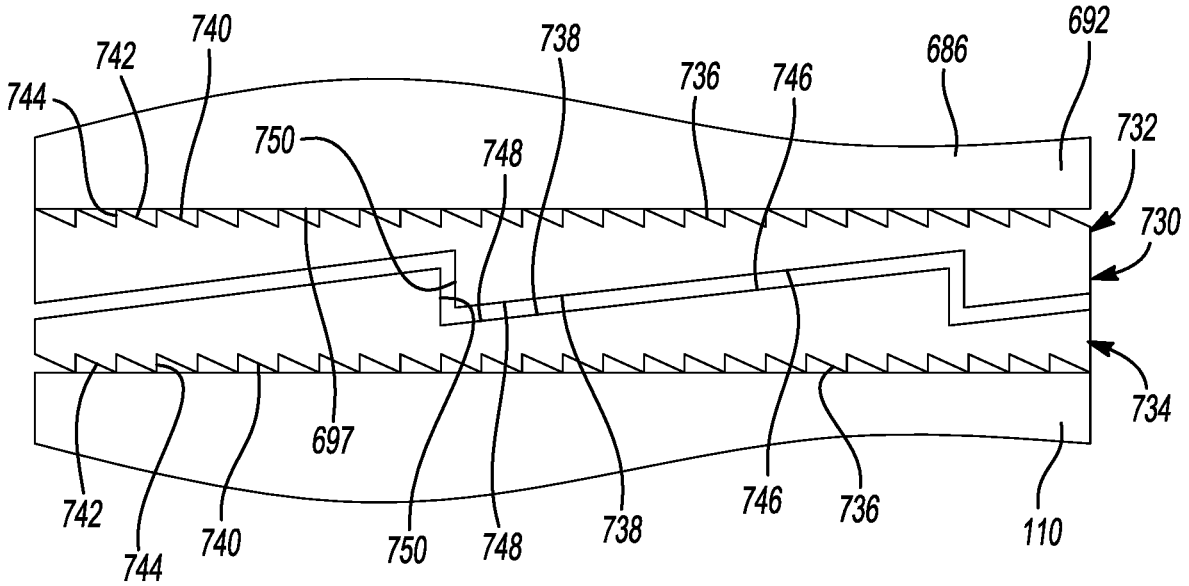
FIG. 13 is a side view of the locking rings engaging the piston and a discharge valve.

As shown in FIGS. 11-13, the piston-retention member 730 may include a first locking ring 732 and a second locking ring 734. The first and second locking rings 732, 734 may be sandwiched between the valve backer 110 of the discharge valve 108 and an axial end 697 (i.e., an axial end opposite the flange portion 694) of the main body 692 of the piston 686. The first and second locking rings 732, 734 may be identical to each other and may each include a first side 736 and a second side 738. The first side 736 of each of the locking rings 732, 734 may include a plurality of first teeth 740 arranged in a circular pattern extending around a longitudinal axis of the locking rings 732, 734. Each of the first teeth 740 may include a ramped surface 742 and a ledge 744. The second side 738 of each of the locking rings 732, 734 may include a plurality of second teeth (or cams) 746 arranged in a circular pattern extending around the longitudinal axis of the locking rings 732, 734. Each of the second teeth 746 may include a ramped surface 748 and a ledge 750.

As shown in FIG. 13, the first side 736 of the first locking ring 732 is engaged with the axial end 697 of the piston 686, the first side 736 of the second locking ring 734 is engaged with an axial end of the valve backer 110 of the discharge valve 108, and the second sides 738 of the locking rings 732, 734 are engaged with each other. As the piston 686 is threaded into engagement with the non-orbiting scroll 54 (i.e., as the piston 686 is threadably tightened within the central recess 75 of the non-orbiting scroll 54), (a) the first teeth 740 of the first locking ring 732 may engage (e.g., dig into) the axial end 697 of the piston 686, (b) the first teeth 740 of the second locking ring 734 may engage (e.g., dig into) the valve backer 110, and (c) the ledges 750 of the second teeth 746 of the first locking ring 732 may engage the ledges 750 of the second teeth 746 of the second locking ring 734. Such engagement among the locking rings 732, 734, the piston 686 and the valve backer 110 may restrict or prevent the piston 686 from unthreading (threadably loosening) from the central recess 75 of the non-orbiting scroll 54.

While the first teeth 740 of the second locking ring 734 are described above as engaging the discharge valve 108, in some configurations of the compressor 10 (e.g., configurations that do not include the discharge valve 108 in the central recess 75), the first teeth 740 of the second locking ring 734 may engage a surface 73 of the end plate 68 of the non-orbiting scroll 54. As shown in FIG. 11, the surface 73 may define an axial end of the central recess 75, and the discharge passage 72 may extend through the surface 73.

By preventing the piston 86, 286, 486, 686 from threadably loosening from the non-orbiting scroll 54, the piston-retention member 130, 330, 530, 730 may reduce or eliminate rattling or vibration of the piston 86, 286, 486, 686 and/or discharge valve 108, which produces undesirable noises during operation of the compressor 10. Furthermore, the piston-retention member 130, 330, 530, 730 can prevent the piston 86, 286, 486, 686 from disengaging the non-orbiting scroll 54, which could prevent the compressor 10 from modulating between the full capacity and reduced capacity modes.

Figure 14:
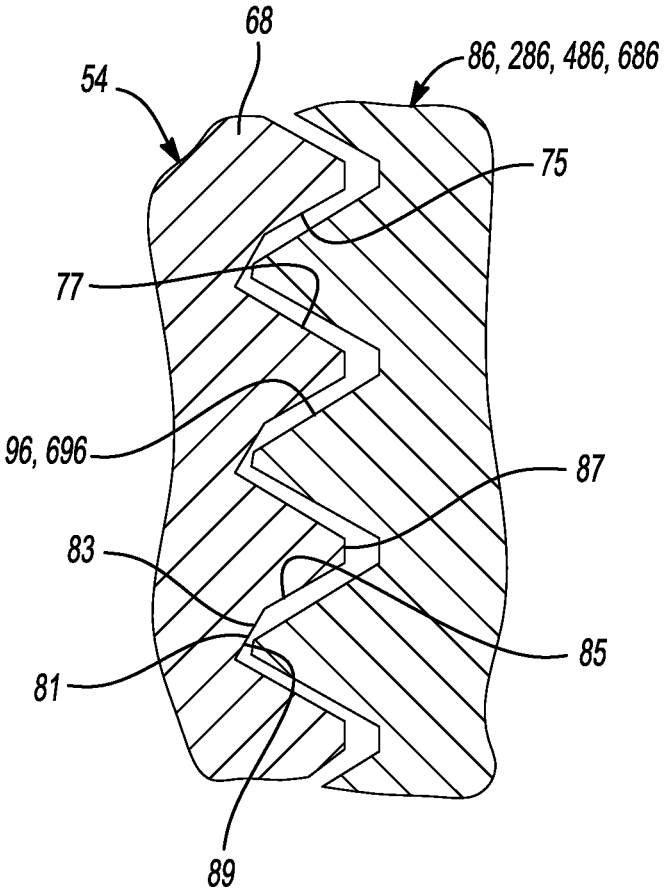
FIG. 14 is a partial cross-sectional view of an embodiment of a piston and an embodiment of a non-orbiting scroll according to the principles of the present disclosure.

In some configurations of the compressor 10, the internal (female) threads 77 of the central recess 75 of the non-orbiting scroll 54 may be self-locking threads. As shown in FIG. 14, the threads 77 may include change in pitch at or adjacent a root 81 of the threads 77. That is, a first portion 83 of the threads 77 at or adjacent the root 81 may have a first pitch, and a second portion 85 of the thread 77 adjacent a crest 87 of the thread 77 may have a second pitch that is different than the first pitch. The first portion 83 having a different pitch than the second portion 85 forms a wedge ramp 89 against which the crest of the threads 96, 696 of the piston 86, 286, 486, 686 is drawn as the piston 86, 286, 486, 686 is threadably tightened within the central recess 75. This restricts or prevents vibration from threadably loosening the piston 86, 286, 486, 686 relative to the non-orbiting scroll 54. It will be appreciated that the threads 77 with wedge ramp 89 can be included in any of the configurations of the compressor 10 described above instead of or in addition to the piston-retention members 130, 330, 530, 730.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly defining a discharge chamber;

a first scroll disposed within the shell assembly and including a first end plate and a first spiral wrap extending from the first end plate;

a second scroll disposed within the shell assembly and including a second end plate and a second spiral wrap extending from the second end plate, the first and second spiral wraps meshing with each other to form a plurality of fluid pockets therebetween;

a piston engaging the first scroll and cooperating with the shell assembly to define a pressure chamber therebetween, wherein the pressure chamber is in selective fluid communication with a first source of working fluid to control movement of the piston relative to the shell assembly; and a piston-retention member engaging the piston and a rotationally fixed structure, wherein the piston-retention member allows rotation of the piston relative to the first scroll in a first rotational direction and restricts rotation of the piston relative to the first scroll in a second rotational direction that is opposite the first rotational direction, and wherein the piston-retention member is movable relative to the piston and the rotationally fixed structure to allow rotation of the piston relative to the first scroll in the first rotational direction.

2. The compressor of claim 1, wherein the rotationally fixed structure is a partition of the shell assembly, wherein the partition partially defines the discharge chamber and a suction chamber.

3. The compressor of claim 2, wherein the piston-retention member is pivotably mounted to the partition and selectively engages one of a plurality of notches formed on the piston.

4. The compressor of claim 3, wherein the piston-retention member is pivotably mounted to a wear ring of the partition.

5. The compressor of claim 2, wherein the piston-retention member is pivotably mounted to the piston and selectively engages one of a plurality of notches formed on the partition.

6. The compressor of claim 5, wherein the plurality of notches are formed on a wear ring of the partition.

7. The compressor of claim 1, wherein the rotationally fixed structure is an end cap of the shell assembly, wherein the end cap partially defines the pressure chamber and the discharge chamber.

8. The compressor of claim 7, wherein the piston-retention member is pivotably mounted to the piston and selectively engages one of a plurality of notches formed on the end cap.

9. The compressor of claim 8, wherein the piston-retention member is disposed in the pressure chamber.

10. The compressor of claim 1, wherein a spring engages the piston-retention member and the rotationally fixed structure, and wherein the spring biases the piston-retention member into engagement with a selected one of a plurality of notches.

11. The compressor of claim 1, wherein the rotationally fixed structure includes the first scroll, wherein the piston-retention member includes a first locking ring and a second locking ring, and wherein the first and second locking rings are disposed axially between an axial end of the piston and a surface of the first end plate.

12. The compressor of claim 11, wherein each of the first and second locking rings include a plurality of first teeth and a plurality of second teeth, wherein the second teeth of the first locking ring engage the second teeth of the second locking ring.

13. The compressor of claim 12, wherein the first teeth of the first locking ring engage the axial end of the piston, wherein the rotationally fixed structure includes a discharge valve disposed axially between the axial end of the piston and the surface of the first end plate, and wherein the first teeth of the second locking ring engage the discharge valve.

14. A compressor comprising:

a shell assembly having an end cap at least partially defining a discharge chamber and a pressure chamber;

a non-orbiting scroll disposed within the shell assembly and including a first end plate and a first spiral wrap extending from the first end plate;

an orbiting scroll disposed within the shell assembly and including a second end plate and a second spiral wrap extending from the second end plate, the first and second spiral wraps meshing with each other to form a plurality of fluid pockets therebetween;

a piston including a main body and a flange portion extending from the main body, wherein the main body threadably engages the non-orbiting scroll, wherein the flange portion is received within a recess defined by the end cap such that the piston cooperates with the end cap to define the pressure chamber, wherein the pressure chamber is in selective fluid communication with a source of working fluid to control movement of the piston relative to the shell assembly; and a piston-retention member engaging the piston and a rotationally fixed structure, wherein the piston-retention member allows threadable rotation of the piston relative to the non-orbiting scroll in a first rotational direction to threadably tighten the piston to the non-orbiting scroll and restricts rotation of the piston relative to the non-orbiting scroll in a second rotational direction to restrict the piston from threadably loosening from the non-orbiting scroll.

15. The compressor of claim 14, wherein the rotationally fixed structure is a partition of the shell assembly, wherein the partition partially defines the discharge chamber and a suction chamber.

16. The compressor of claim 15, wherein the piston-retention member is pivotably mounted to the partition and selectively engages one of a plurality of notches formed on the piston.

17. The compressor of claim 15, wherein the piston-retention member is pivotably mounted to the piston and selectively engages one of a plurality of notches formed on the partition.

18. The compressor of claim 14, wherein the rotationally fixed structure is the end cap of the shell assembly, and wherein the piston-retention member is pivotably mounted to the piston and selectively engages one of a plurality of notches formed on the end cap.

19. The compressor of claim 14, wherein the rotationally fixed structure includes the non-orbiting scroll, wherein the piston-retention member includes a first locking ring and a second locking ring, wherein the first and second locking rings are disposed axially between an axial end of the piston and a surface of the first end plate.

20. The compressor of claim 19, wherein each of the first and second locking rings include a plurality of first teeth and a plurality of second teeth, wherein the second teeth of the first locking ring engage the second teeth of the second locking ring, and wherein the first teeth of the first locking ring engage the axial end of the piston.

21. The compressor of claim 20, wherein the rotationally fixed structure includes a discharge valve disposed axially between the axial end of the piston and the surface of the first end plate, and wherein the first teeth of the second locking ring engage the discharge valve.

* * * * *